US012760637B2

(12) United States Patent
Al-Otaibi et al.

(10) Patent No.: US 12,760,637 B2
(45) Date of Patent: Oct. 13, 2026

(54) FLOATING CONTROLLABLE SURVEILLANCE BALLS FOR MONITORING WELLBORE PARAMETERS

(71) Applicant: SAUDI ARABIAN OIL COMPANY, Dhahran (SA)

(72) Inventors: Hazza G. Al-Otaibi, Hawtah (SA); Ibrahim K. Al-Thwaiqib, Hawtah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 251 days.

(21) Appl. No.: 18/735,033

(22) Filed: Jun. 5, 2024

(65) Prior Publication Data

US 2025/0376923 A1 Dec. 11, 2025

(51) Int. Cl.
*E21B 47/07* (2012.01)
*E21B 47/06* (2012.01)
*E21B 47/12* (2012.01)

(52) U.S. Cl.
CPC ..... *E21B 47/07* (2020.05); *E21B 47/06* (2013.01); *E21B 47/138* (2020.05); *E21B 2200/08* (2020.05)

(58) Field of Classification Search
CPC ..... E21B 47/06; E21B 47/07; E21B 47/138; E21B 2200/08
See application file for complete search history.

(56) References Cited

U.S. PATENT DOCUMENTS

| | | | | |
|---|---|---|---|---|
| 9,080,098 | B2 * | 7/2015 | Xu | C09K 8/805 |
| 10,801,315 | B2 * | 10/2020 | Fripp | E21B 47/26 |
| 2011/0048743 | A1 * | 3/2011 | Stafford | E21B 33/134 166/135 |
| 2019/0316459 | A1 * | 10/2019 | Chen | E21B 43/26 |
| 2024/0410272 | A1 * | 12/2024 | Zhang | E21B 47/138 |

FOREIGN PATENT DOCUMENTS

WO WO-2016025682 A1 * 2/2016 ..... E21B 33/1208

* cited by examiner

*Primary Examiner* — Jill E Culler
(74) *Attorney, Agent, or Firm* — Vorys, Sater, Seymour and Pease LLP

(57) ABSTRACT

A floating controllable device and method is disclosed for monitoring downhole fluid parameters in a wellbore. The floating controllable device has a sphere body with a low density material in relation to the fluid in the wellbore. A plurality of rings is grooved around the sphere body. Each ring is designed to react with a wellbore fluid in the wellbore, dissolve at a rate proportional to a salinity of the fluid, and retard in dissolving at a plurality of levels. Once the ring reacts with the wellbore fluid, the ring starts dissolving its material, thereby lowering the ring density and floating the floating controllable device up to the surface. A hollow sphere inside the sphere body carries a plurality of sensors to sense a plurality of fluid parameters at each level in the wellbore to retrieve the sensed fluid parameters once the floating controllable device floats up to the surface.

20 Claims, 4 Drawing Sheets

FLOATING CONTROLLABLE SURVEILLANCE BALLS FOR MONITORING WELLBORE PARAMETERS

FIELD OF THE DISCLOSURE

The present disclosure relates generally to fluid monitoring devices in wellbores and, more particularly, to a floating controllable surveillance ball and method for monitoring downhole wellbore parameters using the same.

BACKGROUND OF THE DISCLOSURE

Generally, measurement of downhole wellbore parameters within a wellbore, such as pressure and temperature, plays a vital role in the oil and gas industry to monitor a well's performance and ensure well integrity. Anomalies in both surveys of pressure and temperatures may indicate a downhole integrity issue. Accurate pressure and temperature measurements are required to determine various factors considered useful in predicting the success of the operation of the wellbore. Further, pressure and temperature measurements can be utilized to increase the efficiency of the wellbore.

Conventional surveys are done by lowering pressure and temperature gauges into the wellbore using a surface-located slickline unit. Once lowered into the wellbore, the pressure and temperature gauges record data on desired depth range along with specific depths for stationary points. However, erecting and operating a slickline unit can be costly, time-consuming, and present various hazards to personnel, not to mention the increased production deferral time for performing the survey. Moreover, tools conveyed via slickline can sometimes get lost in the wellbore, thus leading to costly fishing operations and resulting in high operational expenditures and increased manpower.

Hence, there is a need in the art for solutions which will overcome the above mentioned drawback(s), among others.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system is disclosed and includes a wellhead installation arranged at a well surface location, a wellbore extending from the wellhead installation and being filled with a wellbore fluid, and a floating controllable surveillance ball conveyable into the wellbore via the wellhead installation and including a body having a density less than a density of the wellbore fluid, and a dissolvable material arranged about an outer circumference of the body and dissolvable in the presence of the wellbore fluid. A combined density of the body and the dissolvable material is greater than the density of the wellbore fluid and thereby causes the floating controllable surveillance ball to descend to a bottom of the wellbore under gravitational forces, and dissolving the dissolvable material in the wellbore fluid progressively decreases the combined density, thereby causing the floating controllable surveillance ball to float back to the wellhead installation for retrieval.

According to another embodiment consistent with the present disclosure, a method of monitoring one or more wellbore parameters in a wellbore is disclosed and includes conveying a floating controllable surveillance ball into a wellbore filled with a wellbore fluid and extending from a wellhead installation, the floating controllable surveillance ball including a body having a density less than a density of the wellbore fluid, and a dissolvable material arranged about an outer circumference of the body and dissolvable in the presence of the wellbore fluid, wherein a combined density of the body and the dissolvable material is greater than the density of the wellbore fluid. The method may further include reacting a first portion of the dissolvable material with the wellbore fluid and thereby dissolving the first portion, decreasing the combined density as the first portion dissolves and thereby causing the floating controllable surveillance ball to ascend uphole and stop at a first level within the wellbore, reacting a second portion of the dissolvable material with the wellbore fluid at the first level and thereby dissolving the second portion, and decreasing the combined density of the floating controllable surveillance ball as the second portion dissolves and thereby causing the floating controllable surveillance ball to ascend uphole and stop a second level within the wellbore.

According to another embodiment consistent with the present disclosure, a floating controllable surveillance ball is disclosed and includes a spherical body that defines an interior, and one or more sensors arranged within the interior and operable to obtain one or more wellbore parameters within a wellbore filled with a wellbore fluid, and a dissolvable material arranged about an outer circumference of the body and dissolvable in the presence of the wellbore fluid, wherein a combined density of the body and the dissolvable material is greater than the density of the wellbore fluid and thereby allows the floating controllable surveillance ball to descend to a bottom of the wellbore under gravitational forces, and wherein dissolving the dissolvable material in the wellbore fluid progressively decreases the combined density, thereby causing the floating controllable surveillance ball to float back to the wellhead installation for retrieval.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
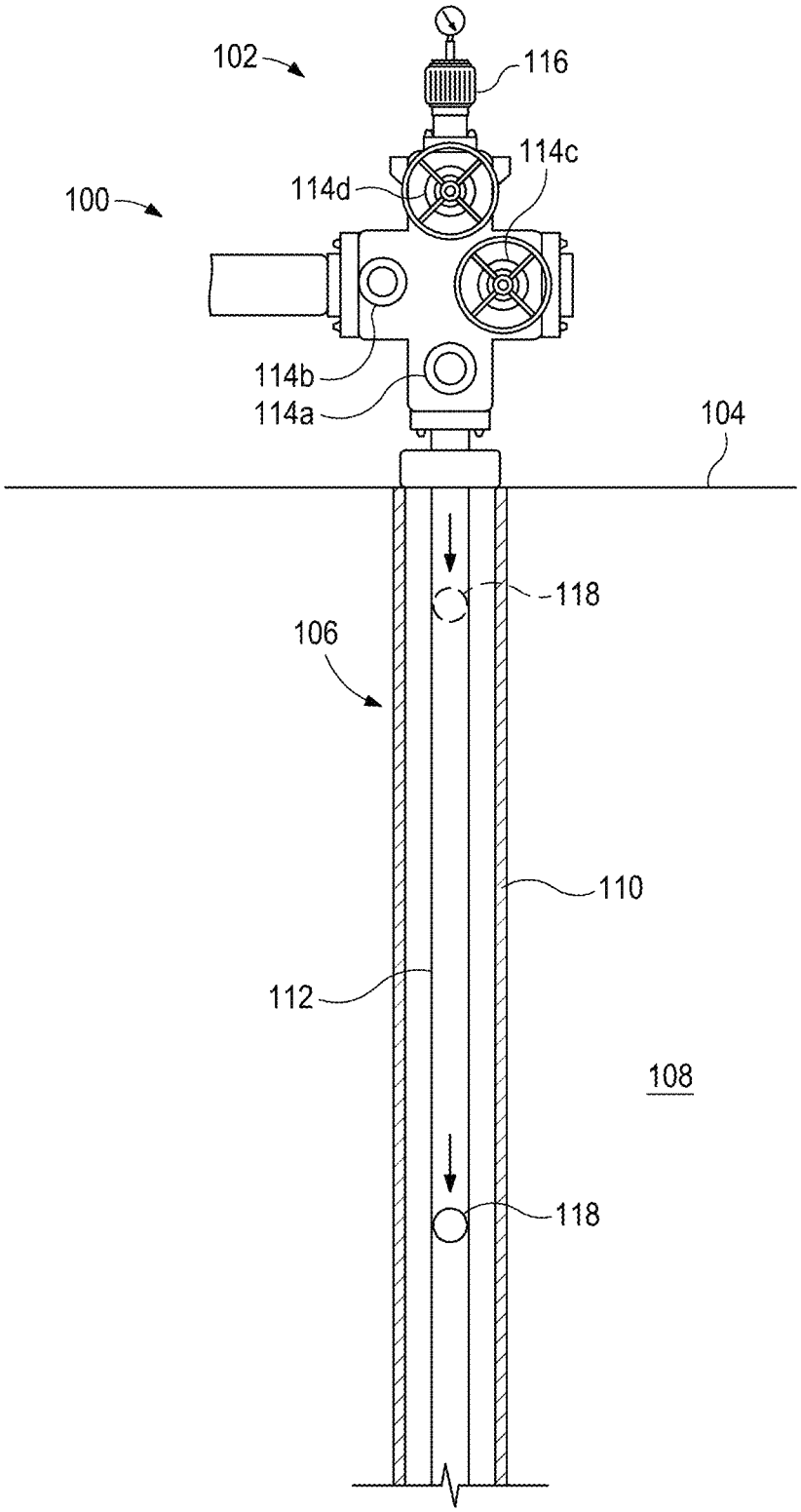
FIG. 1 is a schematic of an example well system that incorporate one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to fluid monitoring devices in wellbores and, more particularly, to a floating controllable surveillance ball and method for monitoring downhole wellbore parameters using the same. The floating controllable surveillance ball may be used in conjunction with a well system that includes a wellhead installation arranged at a well surface location, and a wellbore extending from the wellhead installation and being filled with a wellbore fluid. The floating controllable surveillance ball may be conveyable into the wellbore via the wellhead installation and include a body having a density less than a density of the wellbore fluid, and a dissolvable material arranged about an outer circumference of the body and dissolvable in the presence of the wellbore fluid. A combined density of the body and the dissolvable material is greater than the density of the wellbore fluid and thereby causes the floating controllable surveillance ball to descend to a bottom of the wellbore under gravitational forces, and dissolving the dissolvable material in the wellbore fluid progressively decreases the combined density, thereby causing the floating controllable surveillance ball to float back to the wellhead installation for retrieval. The body of the floating controllable surveillance ball may further define an interior that houses one or more sensors to obtain one or more wellbore parameters within the wellbore as the floating controllable surveillance ball ascends uphole toward the well surface location.

FIG. 1 is a schematic diagram of an example well system 100 that may incorporate the principles of the present disclosure. As illustrated, the well system 100 may include a wellhead installation 102 installed (erected) at a well surface location 104 (e.g., the Earth's surface) and a wellbore 106 extends from the wellhead installation 102 and penetrates one or more subterranean formations 108. While the well system 100 is depicted as a land-based operation, the principles of the present disclosure could equally apply to any offshore, sea-based, or sub-sea application, without departing from the scope of the disclosure.

In some embodiments, as illustrated, the wellbore 106 may be lined with a string of wellbore liner or "casing" 110 cemented in place. In other embodiments, however, the wellbore 106 may be "open hole" and otherwise not lined or completed. A string of production tubing 112 may be extended downhole from the wellhead installation 102 and arranged within the casing 110. The production tubing 112 may provide a conduit for extracting hydrocarbons from the subterranean formations 108, but may also be used to convey fluids and downhole tools to the bottom of the wellbore 106, as desired.

The wellhead installation 102, alternately referred to as a "production tree" or "Christmas tree," generally operates as a means of containing pressure within the wellbore 106. The wellhead installation 102 also operates to control the flow of fluids into and out of the well. For example, the wellhead installation 102 controls the flow of hydrocarbons conveyed to the well surface location 104 via the production tubing 112. The wellhead installation 102 may also be used for controlling the injection of fluids into the well to provide lift or as storage. Moreover, and as described in more detail herein, the wellhead installation 102 may further be used for introducing downhole tools (e.g., sensors and gauges) into the wellbore 106 to perform a variety of operations.

To accomplish the foregoing functions, the wellhead installation 102 includes a series of valves, spools, and fittings that can be manipulated to regulate and maintain pressure within the wellbore 106. In the illustrated embodiment, for example, the wellhead installation 102 includes, but is not limited to, a master valve 114*a*, a wing valve 114*b*, a kill valve 114*c*, and a crown valve 114*d*. Those skilled in the art will readily appreciate that the wellhead installation 102 may include a variety of additional valves applicable to the disclosed embodiments, and without departing from the scope of this disclosure. The wellhead installation 102 may further include a wellhead cap 116, which may be removed in order to introduce various downhole tools into the wellhead installation 102 to be conveyed into the wellbore 106.

According to embodiments of the present disclosure, pressure and temperature surveys of the downhole environment can be performed in the wellbore 106 by introducing a floating controllable surveillance ball 118 into the wellbore 106 from the wellhead installation 102. In the illustrated embodiment, the floating controllable surveillance ball 118 comprises a spherical ball, but could alternatively comprise other types of wellbore projectiles, such as a wellbore dart or a projectile exhibiting other geometries. To introduce the floating controllable surveillance ball 118 into the wellbore 106, the wellhead cap 116 may be removed to allow the floating controllable surveillance ball 118 to be introduced into the wellhead installation 102. By manipulating the crown valve 114*d* and the master valve 114*a*, the floating controllable surveillance ball 118 may be dropped into the wellbore 106 and, more particularly, into the production tubing 112.

The floating controllable surveillance ball 118 may initially be denser than the fluid within the wellbore 106 (e.g., oil, water, or a mixture thereof). Consequently, the floating controllable surveillance ball 118 may be conveyed to the bottom of the wellbore 106 through the wellbore fluids under gravitational forces. As described herein, portions of the floating controllable surveillance ball 118 may be made of a dissolvable and/or degradable material. Once reaching the bottom of the wellbore 106, the floating controllable surveillance ball 118 will settle before reacting and at least partially dissolving. As portions of the floating controllable surveillance ball 118 dissolve, the overall density of the floating controllable surveillance ball 118 correspondingly decreases, thereby making the floating controllable surveillance ball 118 buoyant in the fluid within the wellbore 118. As the floating controllable surveillance ball 118 becomes less dense, it will start to flow back up to the well surface location 104. Moreover, as described herein, the floating controllable surveillance ball 118 may be equipped with pressure and temperature sensors operable to obtain pressure and temperature readings that can be retrieved once recovered at the well surface location 104.

Figure 2:
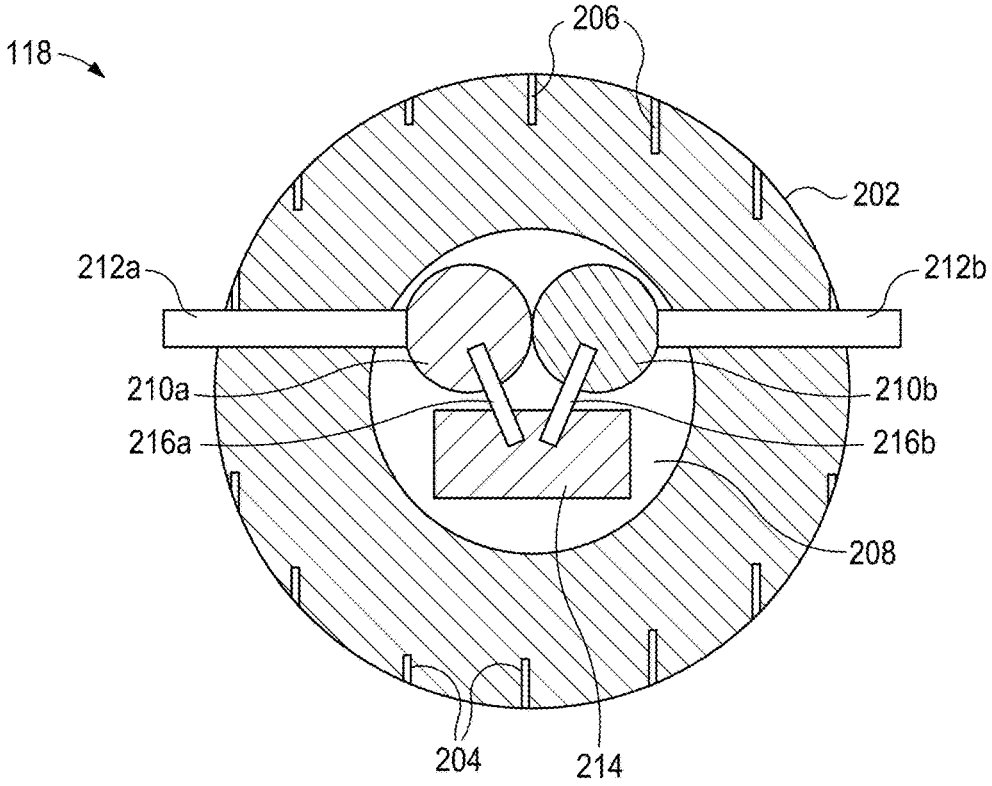
FIG. 2 is a schematic view of an example of the floating controllable surveillance ball of FIG. 1, according to one or more embodiments.

FIG. 2 is a schematic view of an example of the floating controllable surveillance ball 118, according to one or more embodiments. In some embodiments, as illustrated, the floating controllable surveillance ball 118 can be a generally spherical ball having a spherical body 202. In other embodiments, however, the floating controllable surveillance ball 118 can exhibit other designs or non-spherical shapes, without departing from the scope of the disclosure. The body 202 is made of a material that exhibits a density that is lower than the density of the fluids present in the wellbore 106 (FIG. 1). Example materials for the body 202 include, but are not limited to, stainless steel, chrome, nickel, alloys thereof, and the like. Consequently, the floating controllable surveillance ball 118 may be buoyant in the fluids within the wellbore 106, which may be advantageous in allowing the floating controllable surveillance ball to eventually float back to the well surface location 104 (FIG. 1).

In some embodiments, as illustrated, a plurality of pockets or grooves 204 may be defined about the outer circumference of the body 202. In one or more embodiments, the grooves 204 may comprise parallel, annular rings defined in the body 202. In some embodiments, each groove 204 may be filled with a degradable or dissolvable material 206 that is dissolvable in the presence of downhole fluids present within the wellbore 106 (FIG. 1). In other embodiments, however, the grooves 204 may be omitted and the dissolvable material 206 may alternatively be secured to the outer circumference of the body 202. In such embodiments, the dissolvable material 206 may be provided and otherwise arranged in a plurality of parallel, annular rings arranged about the periphery of the body 202.

The terms "degradable" and "dissolvable" may be used herein interchangeably. The term "dissolvable" and all of its grammatical variants (e.g., "dissolve," "dissolution," "dissolving," and the like) refers to the degradation or chemical conversion of materials into smaller components, intermediates, or end products by at least one of solubilization, hydrolytic degradation, biologically formed entities (e.g., bacteria or enzymes), chemical reactions (including electrochemical reactions), thermal reactions, or reactions induced by radiation. In some instances, the dissolution of the material may be sufficient for the mechanical properties of the material to be reduced to a point that the material no longer maintains its integrity and, in essence, falls apart or sloughs off. The conditions for degradation or dissolution are generally wellbore conditions where the fluids within the wellbore 106 (FIG. 1) have a specific pH or salinity concentration that interacts with and degrades the dissolvable material 206.

Accordingly, in some embodiments, the dissolvable material 206 may comprise a salinity dissolvable material and otherwise a material that is dissolvable in the presence of a fluid having a salinity concentration of a predetermined range or percentage. In some embodiments, for example, the salinity concentration required to dissolve the salinity dissolvable material can range from about 100 parts-per-million (ppm) to about 40,000 ppm, and for some water wells the salinity concentration may reach and exceed 60,000 ppm. Based on the aforementioned, and recognizing the salinity concentration of the well, the thickness of the dissolvable material 206 may be adjusted or otherwise optimized to accommodate for the dissolving rate.

One example of a dissolvable material 206 that is salinity dissolvable is a magnesium alloy, which can be mixed (alloyed) with iron (Fe) or nickel (Ni) powders. In other embodiments, however, the dissolvable material 206 may comprise other types of dissolvable or degradable materials, without departing from the scope of the disclosure. A full listing of dissolvable materials suitable for the present disclosure is provided below. For purposes of the present discussion, however, the dissolvable material 206 will be described with reference to a salinity dissolvable material.

The dissolvable material 206 may exhibit a density greater than the fluids present within the wellbore 106 (FIG. 1). Consequently, when the dissolvable material 206 is secured to the body 202 (e.g., arranged within the corresponding grooves 204), the overall density of the floating controllable surveillance ball 118 will be greater than the density of the wellbore fluids, thereby allowing the floating controllable surveillance ball 118 to descend naturally to the bottom of the wellbore 106 under gravitational forces. As portions of the dissolvable material 206 begin to dissolve in the presence of the wellbore fluids, however, the overall density of the floating controllable surveillance ball 118 will decrease, thereby progressively increasing the buoyancy of the floating controllable surveillance ball 118 within the wellbore fluids.

The dissolvable material 206 may be configured to react with the fluids present within the wellbore 106 (FIG. 1), and may dissolve at a rate proportional to the salinity of the wellbore fluids. In some embodiments, the dissolvable material 206 may include a chemical retarding agent or material. In such embodiments, the dissolvable material 206 may comprise a magnesium alloy, and the thickness and concentration of the magnesium alloy may comprise a main factor affecting the dissolving rate. In such embodiments, certain annular rings or portions of the dissolvable material 206 may be configured to dissolve at specific (predetermined) rates or levels. Consequently, the dissolvable material 206 may be mixed with the chemical retarding material to allow the floating controllable surveillance ball 118 to have predetermined stops along its ascent to the well surface location 104 (FIG. 1).

More specifically, the dissolvable material 206 within one groove 204 may be configured to dissolve at a rate that is faster than the dissolution rate of the dissolvable material 206 within an adjacent groove 204. Consequently, the dissolvable material within the first groove 204 may dissolve first in the presence of the wellbore fluids, thereby lowering the density of the floating controllable surveillance ball 118 and allowing the floating controllable surveillance ball 118 to float uphole to a certain point within the wellbore 106 and stop. At that point, the dissolvable material 206 within the adjacent (second) groove 204 may commence dissolving, thereby further reducing the overall density of the floating controllable surveillance ball 118, and allowing the floating controllable surveillance ball 118 to float uphole to another certain point within the wellbore 106 and stop. Stopping at each of these locations along the length the wellbore 106 allows the floating controllable surveillance ball 118 to conduct stationary readings of temperature and/or pressure during its ascent to the well surface location 104.

In some embodiments, the dissolvable material 206 provided within specific grooves 204 may begin to dissolve once subjected to wellbore fluids of a specific salinity. The fluid within the wellbore 106 may have varying gradations of salinity, depending on depth. In some embodiments, the dissolution rate of the dissolvable material 206 can be adjusted and controlled by coating some or all of the dissolvable material 206 with a degradable material, and based on the thickness of the degradable coating. The dissolution rate of the dissolvable material 206 may also be adjusted and otherwise optimized based on requirements of a survey of the wellbore fluid parameters.

In one or more embodiments, the number of grooves 204 and corresponding dissolvable materials 206 may correspond to a salinity dissolving ratio dependent on the various depths targeted within the wellbore and in relation to the density of the wellbore fluid. In other words, the number of grooves 204 and the corresponding dissolvable materials present therein may correspond to various known salinity levels present within the wellbore 106. Consequently, the floating controllable surveillance ball 118 may be configured to stop (cease uphole ascent to the well surface location 104) at a plurality of known depths within the wellbore 106, and depending on known dissolution rates of the dissolvable materials 206. In addition to the number of grooves 204, the volume (size) of the groove 204 that will be filled with the dissolvable material 206 can be larger or smaller depending on the required dissolving rate. In other words, the higher the salinity and temperature, where temperature is mostly proportional to the depth, the greater the number of grooves 204 and higher volume of independent grooves 204, since this may be at least one of the factors that will alter the dissolving ratio, as per the required ball trajectory in the wellbore.

When dropped into the wellbore 106 (FIG. 1) via the wellhead installation 102 (FIG. 1), the floating controllable surveillance ball 118 descends under gravitational forces until reaching a total vertical depth of the wellbore 106. Once reaching total vertical depth, the floating controllable surveillance ball 118 settles before the dissolvable materials 206 commence reacting with the wellbore fluids and dissolving. One or more of the dissolvable materials 206 (e.g., rings of dissolvable materials 206) commence dissolving at specific rates proportional to the amount of chemical retarding material present within the dissolvable material 206, thus lowering the overall density of the floating controllable surveillance ball 118. As its density decreases, the floating controllable surveillance ball 118 may begin to ascend back uphole within the wellbore 106 and stopping (e.g., ceasing uphole movement) at various locations along its ascent based on the dissolution rate of the dissolvable materials 206. Certain or specific rings or portions of dissolvable materials 206 may be configured to dissolve at each stop based on the salinity level of the wellbore fluid at known depths. Accordingly, the floating controllable surveillance ball 118 progressively lowers its density and correspondingly increases its buoyancy, thereby allowing the floating controllable surveillance ball 118 to float uphole to the well surface location 104 (FIG. 1) in stages. Once reaching the well surface location 104, the floating controllable surveillance ball 118 may be retrieved from the wellhead installation 102 (FIG. 1) and wellbore data can be extracted.

In one or more embodiments, the body 202 may be hollow and otherwise define an interior 208, which may be large enough to accommodate and otherwise house various devices or mechanisms. In some embodiments, for example, the interior 208 may include and otherwise house one or more sensors, shown as a temperature sensor 210*a* and a pressure sensor 210*b*. The sensors 210*a,b* are configured to sense a plurality of wellbore parameters at each level (depth) in the wellbore 106 as the floating controllable surveillance ball 118 ascends uphole to the well surface location 104 (FIG. 1). In some embodiments, the temperature sensor 210*a* may include a first sensor rod 212*a* penetrating the body 202 and through which the temperature sensor 210*a* may obtain temperature measurements of the external environment within the wellbore 106. The pressure sensor 210*b* may include a second sensor rod 212*b* penetrating the body 202 to obtain pressure measurements of the external environment within the wellbore 106.

The interior 208 may also contain and otherwise house an instrument housing 214 configured to contain (house) one or more power sources (e.g., batteries, fuel cells, etc.) and a control system. The power source(s) may be configured to provide power to the sensors 210*a,b* and the control system to be able to operate the floating controllable surveillance ball 118 during use. The sensors 210*a,b* are connected to the power source(s) through one or more connector cables 216*a* and 216*b*. The control system may include a memory comprising a computer readable medium having computer executable instructions stored thereon, and a processor (e.g., microprocessor) configured to execute software instructions stored on the memory. The memory may also be configured to store pressure and temperature measurements obtained by the sensors 210*a,b* during use. The stored pressure and temperature measurements 210*a,b* may be retrieved once the floating controllable surveillance ball 118 is received at the well surface location 104 (FIG. 1). In other embodiments, however, the control system may be communicable with the well surface location 104 in real-time, such as via a wireless signal, and thus able to communicate wellbore data in real-time.

In some embodiments, the interior 208 may be hollow, and thus less dense than the body 202 and the wellbore fluids. In other embodiments, however, the interior 208 may be filled with a potting material (e.g., foam, cork, etc.) configured to nest and otherwise receive the various devices or mechanisms arranged within the interior 208. The potting material may comprise a low density medium, exhibiting a density that is lower than the body 202 and the wellbore fluids.

Figure 3:
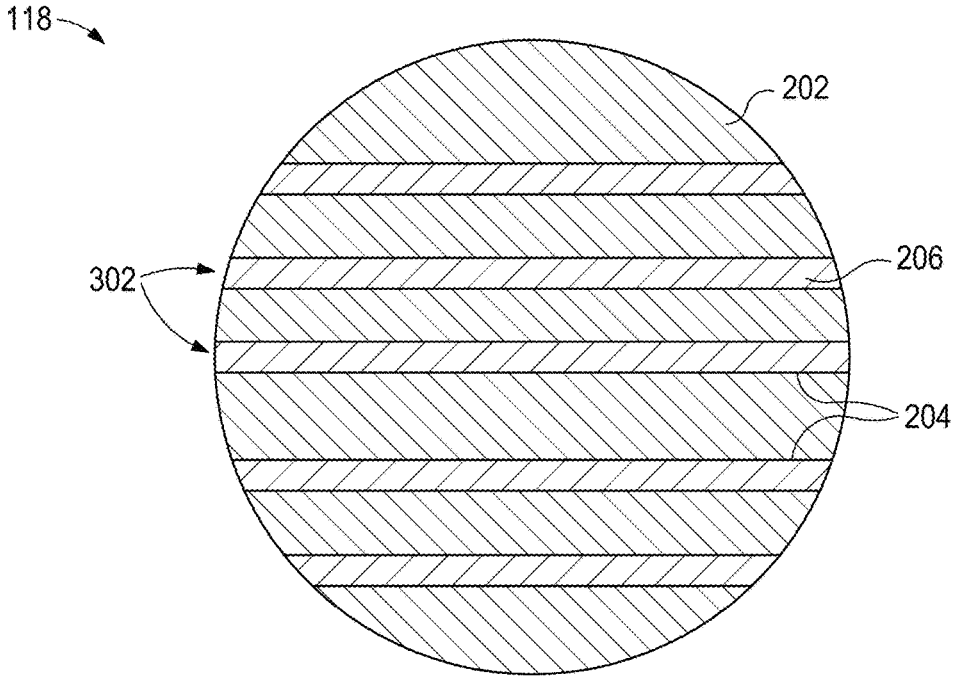
FIG. 3 is a side view of the floating controllable surveillance ball of FIGS. 1 and 2, according to one or more embodiments.

FIG. 3 is a side view of the floating controllable surveillance ball 118, according to one or more embodiments. In some embodiments, as mentioned above, the dissolvable material 206 may be arranged about (e.g., secured to) the outer circumference of the body 202, and may be provided in a plurality of parallel, annular rings 302. As illustrated, the rings 302 may be equidistantly spaced from each other. In other embodiments, however, one or more of the rings 302 need not be parallel to other rings 302, and one or more of the rings 302 may be non-equidistantly spaced from adjacent rings 302, without departing from the scope of the disclosure.

Moreover, as also mentioned above, in some embodiments the dissolvable material 206 may be arranged within corresponding pockets or grooves 204 defined about the outer circumference of the body 202. In at least one embodiment, the grooves 204 may comprise parallel, annular rings, but could alternatively be provided as non-parallel rings. The rings may be equidistantly or non-equidistantly spaced from each other.

Figure 4C:
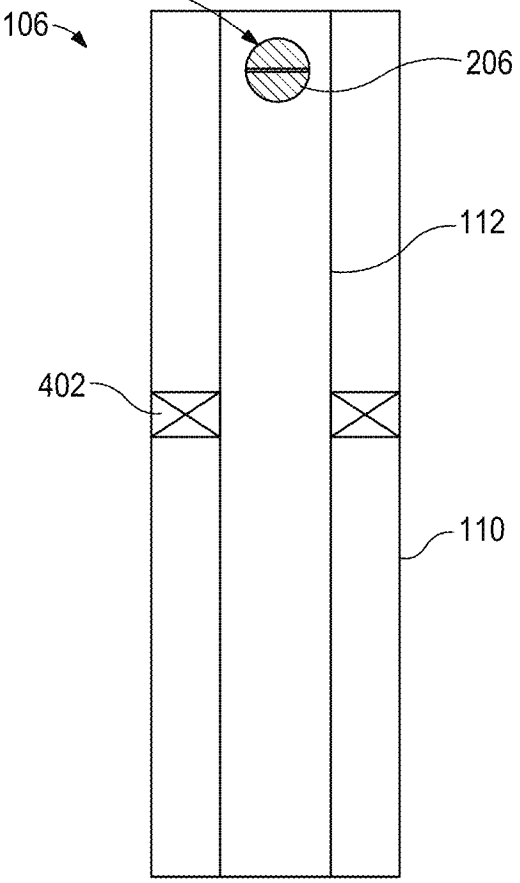
FIGS. 4A-4C are schematic side views of a portion of the wellbore during example operation of the floating controllable surveillance ball, according to one or more embodiments.
Figure 4B:
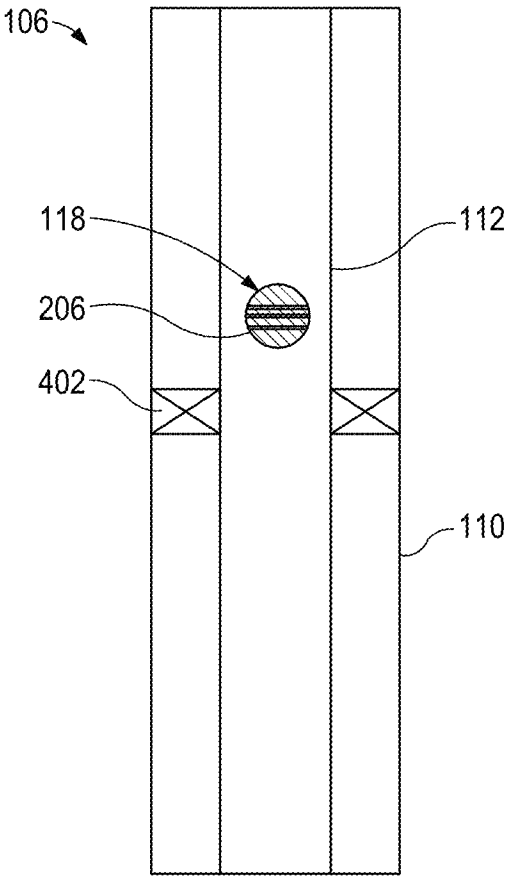
Figure 4A:
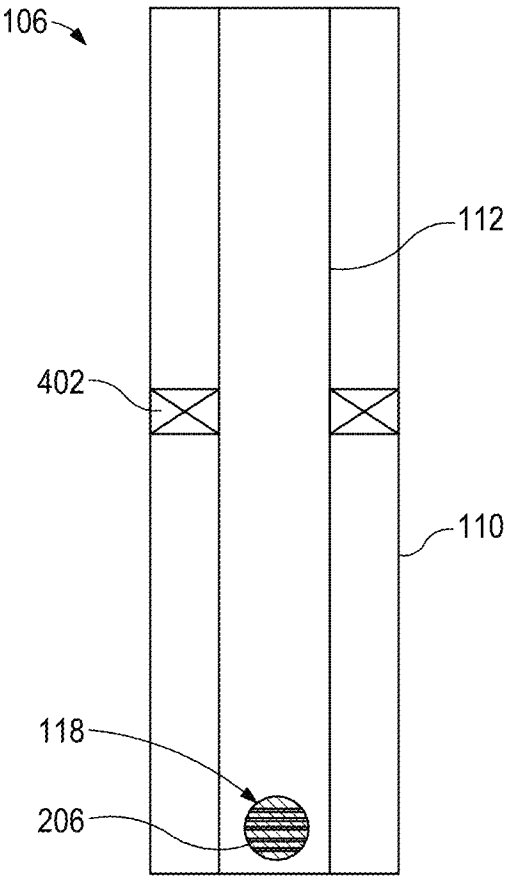

FIGS. 4A-4C are schematic side views of a portion of the wellbore 106 during example operation of the floating controllable surveillance ball 118, according to one or more embodiments. In some embodiments, as illustrated, the wellbore 106 may be lined with the casing 110, which may be cemented in place, and the production tubing 112 may be arranged within the casing 110. In some applications, a wellbore isolation device or "packer" 402 may be deployed in the annulus defined between the casing 110 and the production tubing 112.

FIGS. 4A-4C depict the floating controllable surveillance ball 118 during example uphole ascent as its density progressively decreases. In FIG. 4A, the floating controllable surveillance ball 118 is depicted at or near the bottom of the wellbore 106. Upon initial introduction into the wellbore 106, the density of the floating controllable surveillance ball 118 may be greater than the density of the fluids within the wellbore 106, thereby allowing the floating controllable surveillance ball 118 to naturally drop to the bottom of the wellbore using gravitational forces. Once reaching the bottom, a first portion of the dissolvable material 206 (e.g., one or more first rings) may start to react with the wellbore fluid. As the dissolvable material 206 degrades, the density of the floating controllable surveillance ball 118 decreases, thus allowing the floating controllable surveillance ball 118 to float uphole within the wellbore 106.

In FIG. 4B, the floating controllable surveillance ball 118 is shown stopped at a first stop or level within the wellbore 206. The first portion of the dissolvable material 206 already dissolved allowed the floating controllable surveillance ball 118 to ascend to and stop at the first level. While at the first level, the sensors 210*a,b* (FIG. 2) may be activated to obtain and store (or transmit) one or more wellbore parameters, such as pressure and temperature at the first level. Moreover, while at the first level, a second portion of the dissolvable material 206 (e.g., one or more second rings) may start to react with the wellbore fluid. As the second portion of the dissolvable material 206 degrades, the density of the floating controllable surveillance ball 118 further decreases, thus allowing the floating controllable surveillance ball 118 to float uphole further within the wellbore 106.

In FIG. 4C, the floating controllable surveillance ball 118 is shown stopped at a second stop or level within the wellbore 206. The first and second portions of the dissolvable material 206 already dissolved allowed the floating controllable surveillance ball 118 to ascend to and stop at the second level. While at the second level, the sensors 210*a,b* (FIG. 2) may again be activated to obtain and store (or transmit) one or more wellbore parameters, such as pressure and temperature at the second level. Moreover, while at the second level, a third portion of the dissolvable material 206 (e.g., one or more third rings) may start to react with the wellbore fluid. As the third portion of the dissolvable material 206 degrades, the density of the floating controllable surveillance ball 118 further decreases, thus allowing the floating controllable surveillance ball 118 to float uphole further within the wellbore 106. This process may continue until the floating controllable surveillance ball 118 reaches the well surface location 104 (FIG. 1) where the floating controllable surveillance ball 118 can be retrieved from the wellhead installation 102 (FIG. 1).

Figure 5:
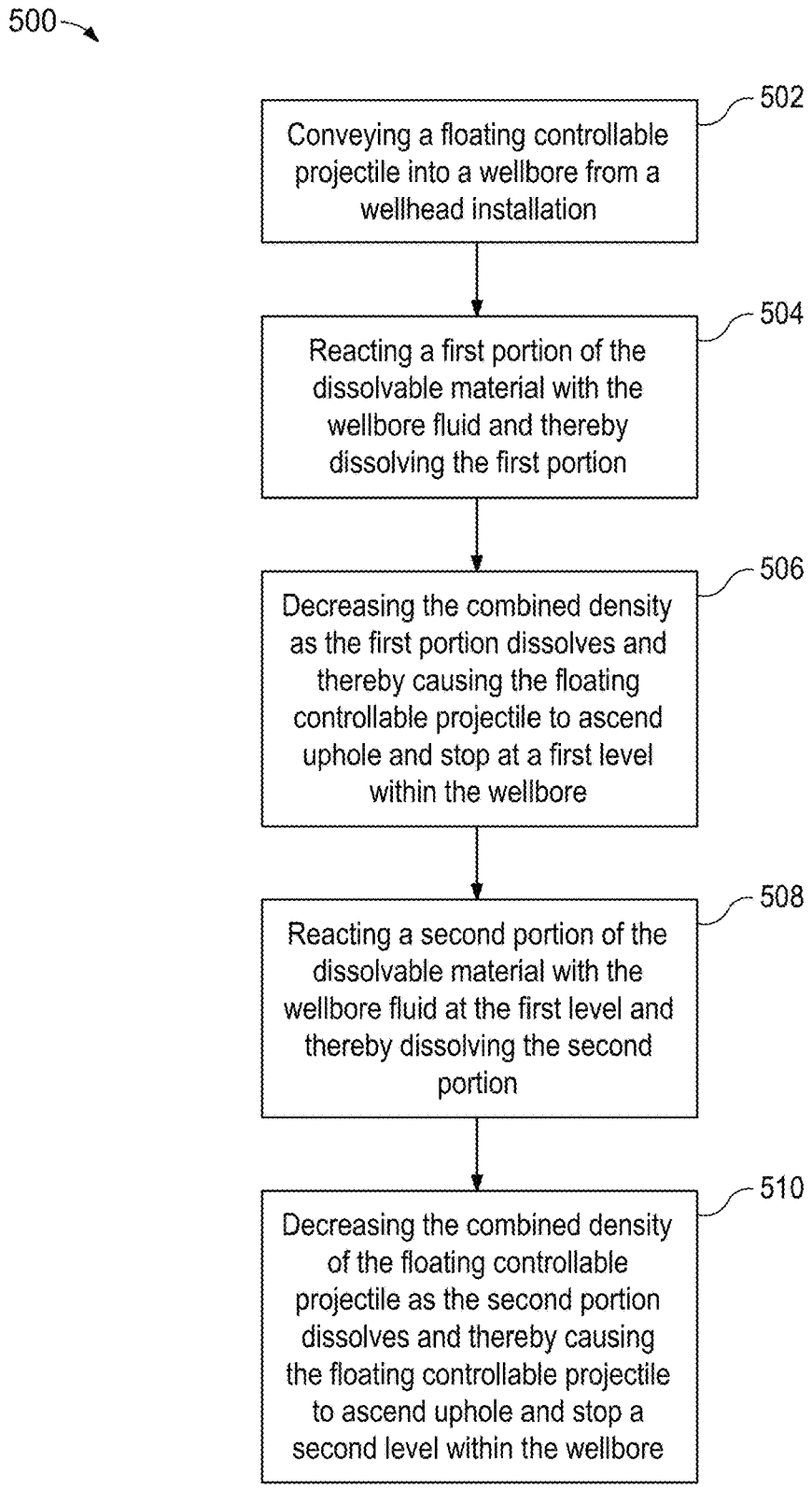
FIG. 5 is a schematic flow chart of an example method for monitoring wellbore parameters in a wellbore using the floating controllable surveillance ball, according to the principles of the present disclosure.

FIG. 5 is a schematic flow chart of an example method 500 for monitoring wellbore parameters in a wellbore using the floating controllable surveillance ball 118, according to the principles of the present disclosure. The method 500 may include conveying the floating controllable surveillance ball into a wellbore filled with a wellbore fluid and extending from a wellhead installation, as at 502. The floating controllable surveillance ball may include a body having a density less than a density of the wellbore fluid, and a dissolvable material arranged about an outer circumference of the body and dissolvable in the presence of the wellbore fluid, wherein a combined density of the body and the dissolvable material is greater than the density of the wellbore fluid. The method 500 may also include reacting a first portion of the dissolvable material with the wellbore fluid and thereby dissolving the first portion, as at 504, and decreasing the combined density as the first portion dissolves and thereby causing the floating controllable surveillance ball to ascend uphole and stop at a first level within the wellbore, as at 506. The method 500 may further include reacting a second portion of the dissolvable material with the wellbore fluid at the first level and thereby dissolving the second portion, as at 508, and decreasing the combined density of the floating controllable surveillance ball as the second portion dissolves and thereby causing the floating controllable surveillance ball to ascend uphole and stop a second level within the wellbore, as at 510.

Thereafter, the method 500 comprises dissolving, by each dissolvable material 206 of the floating controllable surveillance ball 118, at a rate proportional to a salinity of the fluid, as depicted in step 406. The method 500 comprises retarding, by each dissolvable material 206 of the floating controllable surveillance ball 118, in dissolving at a plurality of levels, as depicted in step 408, to lower the density of the floating controllable surveillance ball 118 to provide a plurality of levels. The method 500 comprises sensing, by a plurality of sensors 210*a,b* of the floating controllable surveillance ball 118, a plurality of wellbore parameters at each level in the wellbore, as depicted in step 410. Further, the method 500 comprises floating, by the floating controllable surveillance ball 118, up to a surface of the wellbore by dissolving and retarding at each level, as depicted in step 412, for enabling retrieval of the wellbore parameters.

The various actions in method 500 may be performed in the order presented, in a different order or simultaneously. Further, in some embodiments, some actions listed in FIG. 4 may be omitted.

Thus, the proposed floating controllable surveillance ball 118 can be used based on a plurality of conditions such as wellbore is full of fluid, salinity of wellbore fluid is known, survey to be done in vertical section, and mono-bore completion.

The proposed floating controllable surveillance ball 118 provides an alternative solution for pressure and temperature surveys performed in oil and gas industry to monitor well's performance and ensures well integrity. The floating controllable surveillance ball 118 provides the pressure and temperature surveys data with stationary levels without risking losing of the tools in-hole. The floating controllable surveillance ball 118 eliminates the hazards of rigging up the slick-line system and ultimately lowers the operational expenditures, by reducing the employees needed to perform the survey and reducing production deferral time. This eliminates the risks involved in conventional slick-line interventions of Health, Safety, Security and Environment (HSSE), and operational and manpower need.

Dissolvable or Degradable Materials

The degradation rate of a given dissolvable material may be accelerated, rapid, or normal, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 10 days, 11 days, 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Accordingly, degradation of the dissolvable material may be between about 30 minutes to about 40 days, depending on a number of factors including, but not limited to, the type of dissolvable material selected, the conditions of the wellbore environment, and the like.

Suitable dissolvable materials that may be used in accordance with the embodiments of the present disclosure include dissolvable metals, galvanically-corrodible metals, degradable polymers, a degradable rubber, borate glass, polyglycolic acid (PGA), polylactic acid (PLA), dehydrated salts, and any combination thereof. Suitable dissolvable materials may also include an epoxy resin exposed to a caustic solution, fiberglass exposed to an acid, aluminum exposed to an acidic fluid, and a binding agent exposed to a caustic or acidic solution. The dissolvable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the dissolvable material of aqueous or hydrocarbon fluids present within the wellbore environment such that the mechanical properties of the dissolvable material degrade or fail. In degradation by swelling, the dissolvable material continues to absorb the aqueous and/or hydrocarbon fluid until its mechanical properties are no longer capable of maintaining the integrity of the dissolvable material and it at least partially falls apart. In some embodiments, the dissolvable material may be designed to only partially degrade by swelling in order to ensure that the mechanical properties of the component formed from the dissolvable material is sufficiently capable of lasting for the duration of the specific operation in which it is utilized.

Example aqueous fluids that may be used to swell and degrade the dissolvable material include, but are not limited to, fresh water, saltwater (e.g., water containing one or more salts dissolved therein), brine (e.g., saturated salt water), seawater, acid, bases, or combinations thereof. Example hydrocarbon fluids that may swell and degrade the dissolvable material include, but are not limited to, crude oil, a fractional distillate of crude oil, a saturated hydrocarbon, an unsaturated hydrocarbon, a branched hydrocarbon, a cyclic hydrocarbon, and any combination thereof.

Degradation by dissolving involves a dissolvable material that is soluble or otherwise susceptible to an aqueous fluid or a hydrocarbon fluid, such that the aqueous or hydrocarbon fluid is not necessarily incorporated into the dissolvable material (as is the case with degradation by swelling), but becomes soluble upon contact with the aqueous or hydrocarbon fluid.

Degradation by undergoing a chemical change may involve breaking the bonds of the backbone of the dissolvable material (e.g., a polymer backbone) or causing the bonds of the dissolvable material to crosslink, such that the dissolvable material becomes brittle and breaks into small pieces upon contact with even small forces expected in the wellbore environment.

Thermal degradation of the dissolvable material involves a chemical decomposition due to heat, such as heat that may be present in a wellbore environment. Thermal degradation of some dissolvable materials mentioned or contemplated herein may occur at wellbore environment temperatures that exceed about 93° C. (or about 200° F.).

With respect to dissolvable or galvanically-corrodible metals used as a dissolvable material, the metal may be configured to degrade by dissolution in the presence of an aqueous fluid or via an electrochemical process in which a galvanically-corrodible metal corrodes in the presence of an electrolyte (e.g., brine or other salt-containing fluids). Suitable dissolvable or galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera. Of these galvanically-corrodible metals, magnesium and magnesium alloys may be preferred.

With respect to degradable polymers used as a dissolvable material, a polymer is considered "degradable" or "dissolvable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(ε-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof.

Polyanhydrides are another type of particularly suitable degradable polymer useful in the embodiments of the present disclosure. Polyanhydrides hydrolyze in the presence of aqueous fluids to liberate the constituent monomers or comonomers, yielding carboxylic acids as the final degradation products. The erosion time can be varied over a broad range of changes to the polymer backbone, including varying the molecular weight, composition, or derivatization. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the dissolvable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the dissolvable material forming the component may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the dissolvable material, encompassing any value or subset therebetween.

Embodiments disclosed herein include:

A. A well system that includes a wellhead installation arranged at a well surface location, a wellbore extending from the wellhead installation and being filled with a wellbore fluid, and a floating controllable surveillance ball conveyable into the wellbore via the wellhead installation and including a body having a density less than a density of the wellbore fluid, and a dissolvable material arranged about an outer circumference of the body and dissolvable in the presence of the wellbore fluid, wherein a combined density of the body and the dissolvable material is greater than the density of the wellbore fluid and thereby causes the floating controllable surveillance ball to descend to a bottom of the wellbore under gravitational forces, and wherein dissolving the dissolvable material in the wellbore fluid progressively decreases the combined density, thereby causing the floating controllable surveillance ball to float back to the wellhead installation for retrieval.

B. A method of monitoring one or more wellbore parameters in a wellbore includes the steps of conveying a floating controllable surveillance ball into a wellbore filled with a wellbore fluid and extending from a wellhead installation, the floating controllable surveillance ball including a body having a density less than a density of the wellbore fluid, and a dissolvable material arranged about an outer circumference of the body and dissolvable in the presence of the wellbore fluid, wherein a combined density of the body and the dissolvable material is greater than the density of the wellbore fluid. The method further including the steps of reacting a first portion of the dissolvable material with the wellbore fluid and thereby dissolving the first portion, decreasing the combined density as the first portion dissolves and thereby causing the floating controllable surveillance ball to ascend uphole and stop at a first level within the wellbore, reacting a second portion of the dissolvable material with the wellbore fluid at the first level and thereby dissolving the second portion, and decreasing the combined density of the floating controllable surveillance ball as the second portion dissolves and thereby causing the floating controllable surveillance ball to ascend uphole and stop a second level within the wellbore.

C. A floating controllable surveillance ball includes a spherical body that defines an interior, one or more sensors arranged within the interior and operable to obtain one or more wellbore parameters within a wellbore filled with a wellbore fluid, and a dissolvable material arranged about an outer circumference of the body and dissolvable in the presence of the wellbore fluid, wherein a combined density of the body and the dissolvable material is greater than the density of the wellbore fluid and thereby allows the floating controllable surveillance ball to descend to a bottom of the wellbore under gravitational forces, and wherein dissolving the dissolvable material in the wellbore fluid progressively decreases the combined density, thereby causing the floating controllable surveillance ball to float back to the wellhead installation for retrieval.

Each of embodiments A, B, and C may have one or more of the following additional elements in any combination: Element 1: wherein the body comprises a spherical ball. Element 2: wherein the dissolvable material is arranged in a plurality of annular rings disposed about the outer circumference of the body. Element 3: wherein the dissolvable material is arranged within a plurality of grooves defined in the outer circumference of the body. Element 4: wherein the dissolvable material includes a chemical retarding agent such that the dissolving material arranged in a first annular ring of the plurality of annular rings dissolves at a first rate and the dissolving material arranged in a second annular ring of the plurality of annular rings dissolves at a second rate slower than the first rate. Element 5: wherein the dissolvable material comprises a salinity dissolvable material, and wherein a number of the plurality of annular rings corresponds to a number of known salinity levels present within the wellbore. Element 6: wherein the dissolvable material comprises a magnesium alloy. Element 7: wherein the dissolvable material dissolves at a rate proportional to a salinity concentration of the wellbore fluid. Element 8: wherein the body defines an interior and the floating controllable surveillance ball further includes one or more sensors arranged within the interior and operable to obtain one or more wellbore parameters within the wellbore as the floating controllable surveillance ball ascends uphole toward the well surface location, and an instrument housing arranged within the interior and housing a power source that powers the one or more sensors, and a control system in communication with the one or more sensors. Element 9: wherein the sensors include at least a temperature sensor and a pressure sensor.

Element 10: wherein conveying the floating controllable surveillance ball into the wellbore comprises allowing the floating controllable surveillance ball to descend to a bottom of the wellbore under gravitational forces. Element 11: wherein the dissolvable material is arranged in a plurality of annular rings, the first portion being provided in a first annular ring of the plurality of annular rings, and the second portion being provided in a second annular ring of the plurality of annular rings. Element 12: wherein the dissolvable material includes a chemical retarding agent, the method further comprising dissolving the first portion at a first rate based on a first amount of the chemical retarding agent included in the first portion, and dissolving the second portion at a second rate slower than the first rate based on a second amount of the chemical retarding agent included in the second portion. Element 13: wherein the body defines an interior that houses one or more sensors, the method further comprising obtaining one or more first wellbore parameters within the wellbore at the first level with the one or more sensors, obtaining one or more second wellbore parameters within the wellbore at the second level with the one or more sensors, receiving the floating controllable surveillance ball at the wellhead installation, and retrieving the one or more first and second wellbore parameters from the floating controllable surveillance ball.

Element 14: wherein the dissolvable material is provided in a plurality of annular rings arranged about the outer circumference of the body. Element 15: wherein the dissolvable material is arranged within a plurality of grooves defined in the outer circumference of the body. Element 16: wherein the dissolvable material includes a chemical retarding agent such that the dissolving material arranged in a first annular ring of the plurality of annular rings dissolves at a first rate and the dissolving material arranged in a second annular ring of the plurality of annular rings dissolves at a second rate slower than the first rate. Element 17: wherein the dissolvable material comprises a magnesium alloy.

By way of non-limiting example, exemplary combinations applicable to A, B, and C include: Element 2 with Element 3; Element 2 with Element 4; Element 2 with Element 5; Element 8 with Element 9; Element 11 with Element 12; and Element 14 with Element 15.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, up-hole, downhole and the like are used in relation to the illustrative embodiments as they are depicted in the figures, the upward direction being toward the top of the corresponding figure and the downward direction being toward the bottom of the corresponding figure, the up-hole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellhead installation arranged at a well surface location;

a wellbore extending from the wellhead installation and being filled with a wellbore fluid; and a floating controllable surveillance ball conveyable into the wellbore via the wellhead installation and including:

a body having a density less than a density of the wellbore fluid; and a dissolvable material arranged in a plurality of annular rings disposed about an outer circumference of the body and dissolvable in the presence of the wellbore fluid, wherein a combined density of the body and the dissolvable material is greater than the density of the wellbore fluid and thereby causes the floating controllable surveillance ball to descend to a bottom of the wellbore under gravitational forces, wherein dissolving the dissolvable material in the wellbore fluid progressively decreases the combined density, thereby causing the floating controllable surveillance ball to float back to the wellhead installation for retrieval, and wherein dissolution of each annular ring in the wellbore fluid progressively decreases the combined density of the floating controllable surveillance ball, thereby controlling an ascent trajectory of the floating controllable surveillance ball within the wellbore.

2. The well system of claim 1, wherein the body comprises a spherical ball.

3. The well system of claim 1, wherein the dissolvable material is arranged within a plurality of grooves defined in the outer circumference of the body.

4. The well system of claim 1, wherein the dissolvable material includes a chemical retarding agent such that the dissolving material arranged in a first annular ring of the plurality of annular rings dissolves at a first rate and the dissolving material arranged in a second annular ring of the plurality of annular rings dissolves at a second rate slower than the first rate.

5. The well system of claim 1, wherein the dissolvable material comprises a salinity dissolvable material, and wherein a number of the plurality of annular rings corresponds to a number of known salinity levels present within the wellbore.

6. The well system of claim 1, wherein the dissolvable material comprises a magnesium alloy.

7. The well system of claim 1, wherein the dissolvable material dissolves at a rate proportional to a salinity concentration of the wellbore fluid.

8. The well system of claim 1, wherein the body defines an interior and the floating controllable surveillance ball further includes:

one or more sensors arranged within the interior and operable to obtain one or more wellbore parameters within the wellbore as the floating controllable surveillance ball ascends uphole toward the well surface location; and an instrument housing arranged within the interior and housing a power source that powers the one or more sensors, and a control system in communication with the one or more sensors.

9. The well system of claim 8, wherein the sensors include at least a temperature sensor and a pressure sensor.

10. The well system of claim 1, wherein dissolution of a first annular ring of the plurality of annular rings causes the floating controllable surveillance ball to ascend uphole and stop at a first level within the wellbore, and dissolution of a second annular ring of the plurality of annular rings causes the floating controllable surveillance ball to ascend uphole and stop at a second level within the wellbore.

11. The well system of claim 1, wherein the body defines an interior filled with a potting material exhibiting a density lower than the body and lower than the wellbore fluid.

12. A method of monitoring one or more wellbore parameters in a wellbore, comprising:

conveying a floating controllable surveillance ball into a wellbore filled with a wellbore fluid and extending from a wellhead installation, the floating controllable surveillance ball including:

a body having a density less than a density of the wellbore fluid; and a dissolvable material arranged in a plurality of annular rings disposed about an outer circumference of the body and dissolvable in the presence of the wellbore fluid, wherein a combined density of the body and the dissolvable material is greater than the density of the wellbore fluid;

reacting a first portion of the dissolvable material provided in a first annular ring of the plurality of annular rings with the wellbore fluid and thereby dissolving the first portion;

decreasing the combined density as the first portion dissolves and thereby causing the floating controllable surveillance ball to ascend uphole and stop at a first level within the wellbore, wherein the floating controllable surveillance ball remains stationary at the first level while the combined density equals the density of the wellbore fluid at the first level;

reacting a second portion of the dissolvable material provided in a second annular ring of the plurality of annular rings with the wellbore fluid at the first level and thereby dissolving the second portion; and decreasing the combined density of the floating controllable surveillance ball as the second portion dissolves and thereby causing the floating controllable surveillance ball to ascend uphole and stop a second level within the wellbore, wherein the floating controllable surveillance ball remains stationary at the second level while the combined density equals the density of the wellbore fluid at the second level.

13. The method of claim 12, wherein conveying the floating controllable surveillance ball into the wellbore comprises allowing the floating controllable surveillance ball to descend to a bottom of the wellbore under gravitational forces.

14. The method of claim 12, wherein the dissolvable material includes a chemical retarding agent, the method further comprising:

dissolving the first portion at a first rate based on a first amount of the chemical retarding agent included in the first portion, and thereby causing the floating controllable surveillance ball to ascend uphole and stop at the first level; and dissolving the second portion at a second rate slower than the first rate based on a second amount of the chemical retarding agent included in the second portion, and thereby causing the floating controllable surveillance ball to ascend uphole from the first level and stop at the second level.

15. The method of claim 12, wherein the body defines an interior that houses one or more sensors, the method further comprising:

obtaining one or more first wellbore parameters within the wellbore at the first level with the one or more sensors;

obtaining one or more second wellbore parameters within the wellbore at the second level with the one or more sensors;

receiving the floating controllable surveillance ball at the wellhead installation; and retrieving the one or more first and second wellbore parameters from the floating controllable surveillance ball.

16. A floating controllable surveillance ball, comprising:

a spherical body that defines an interior;

one or more sensors arranged within the interior and operable to obtain one or more wellbore parameters within a wellbore filled with a wellbore fluid; and a dissolvable material arranged in a plurality of annular rings disposed about an outer circumference of the body and dissolvable in the presence of the wellbore fluid, wherein a combined density of the body and the dissolvable material is greater than a density of the wellbore fluid and thereby allows the floating controllable surveillance ball to descend to a bottom of the wellbore under gravitational forces, and wherein dissolving the dissolvable material in the wellbore fluid progressively decreases the combined density, thereby causing the floating controllable surveillance ball to float back to the wellhead installation for retrieval, and wherein dissolution of each annular ring in the wellbore fluid progressively decreases a combined density of the floating controllable surveillance ball, thereby controlling an ascent trajectory of the floating controllable surveillance ball within the wellbore.

17. The floating controllable surveillance ball of claim 16, wherein the dissolvable material is arranged within a plurality of grooves defined in the outer circumference of the body.

18. The floating controllable surveillance ball of claim 16, wherein the dissolvable material includes a chemical retarding agent such that the dissolving material arranged in a first annular ring of the plurality of annular rings dissolves at a first rate and the dissolving material arranged in a second annular ring of the plurality of annular rings dissolves at a second rate slower than the first rate.

19. The floating controllable surveillance ball of claim 16, wherein the dissolvable material comprises a magnesium alloy.

20. The floating controllable surveillance ball of claim 16, wherein dissolution of a first annular ring of the plurality of annular rings causes the floating controllable surveillance ball to ascend uphole and stop at a first level within the wellbore, and dissolution of a second annular ring of the plurality of annular rings causes the floating controllable surveillance ball to ascend uphole and stop at a second level within the wellbore.

* * * * *